US006601355B2

(12) United States Patent
Kreitz et al.

(10) Patent No.: US 6,601,355 B2
(45) Date of Patent: Aug. 5, 2003

(54) WALL PROTECTOR INSTALLATION

(75) Inventors: Robert Kreitz, Williamsport, PA (US); Thomas A. Shreiner, Picture Rocks, PA (US)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

(21) Appl. No.: 09/884,352

(22) Filed: Jun. 19, 2001

(65) Prior Publication Data

US 2002/0189181 A1 Dec. 19, 2002

(51) Int. Cl.[7] ..... E04B 2/00

(52) U.S. Cl. ..... 52/287.1; 52/255; 52/254; 52/256; 52/288.1; 52/718.06

(58) Field of Search ..... 52/254, 255, 256, 52/287.1, 288.1, 718.06

(56) References Cited

U.S. PATENT DOCUMENTS 4,161,853 A * 7/1979 Weiss et al. ..... 52/288
4,706,426 A * 11/1987 Rumsey ..... 52/288
RE34,547 E * 2/1994 Weldy ..... 52/288.1

* cited by examiner

*Primary Examiner*—Carl D. Friedman
*Assistant Examiner*—Nahid Amiri
(74) *Attorney, Agent, or Firm*—Baker Botts LLP

(57) ABSTRACT

A wall protection assembly includes an elongated wall protector member having an impact surface adapted to face away from a wall and a mounting surface adapted to face the wall. At least two resilient mounting clips secure the protector member to the wall. Each mounting clip has a mounting base adapted to be affixed to the wall in concealed relation to the protector member and at least one resilient hook projecting from the base and received in a groove in the protector member in captured relation.

21 Claims, 4 Drawing Sheets

WALL PROTECTOR INSTALLATION

BACKGROUND OF THE INVENTION

Wall protectors are widely used in the rooms and corridors of commercial and institutional buildings that are frequented by carts and other conveyances to protect the walls from impacts that could cause marring and cracking. One form of wall protector is a crash guard, which is an elongated member of durable material that is usually mounted on a wall surface parallel to and a few inches above the floor. The front exposed surface of a crash guard is located an inch or so from the wall surface and prevents carts and other conveyances from directly contacting the wall by itself receiving impacts and deflecting the cart. Corner guards are applied vertically to external wall corners to receive impacts.

One form of wall protector that is in widespread use has a metal retainer that is affixed to the wall and receives and supports a cover, which is commonly a sheet of polymeric material, such as polyvinyl chloride, that is formed in cross section to fit over, be retained by and conceal the retainer. Wall protectors of the type having retainers and covers have the advantage of permitting the retainers to be fastened to the wall by fasteners that are exposed on the outside surface of the retainer for ease of installation but are not visible because they are concealed by the covers. They have the disadvantages of being relatively expensive and being composed of several parts, such as end caps that close the ends of each section and fasteners for the end caps.

Wood wall protectors are often used because of their good appearance, relatively low cost, and ease of installation. Generally, wood wall protectors are fastened to the wall by screws that are installed from the external surface in exposed holes, thus leaving the head of the screw visible or requiring the installation of a plug, which is also visible but is more attractive in appearance than is an exposed fastener. One-piece protectors of other materials, such as a rigid plastic foam with a hard skin or a moderately hard rubber likewise usually require installation with screws having exposed heads or visible plugs that conceal the screw heads.

SUMMARY OF THE INVENTION

One object of the present invention is to provide a wall protection assembly, which is especially useful for one-piece wall protectors of a solid material, in which there are no visible screw heads or plugs. Another object is to provide a wall protection assembly that is economical, attractive, and easy to install. Still a further object is to provide a wall protection system in which the protector members are strongly fastened to the wall and will not be dislodged, even by heavy impacts.

The foregoing objects are attained, in accordance with the present invention, by a wall protection assembly that includes an elongated wall protector member having an impact surface adapted to face away from a wall and a mounting surface adapted to engage the wall. An elongated groove extends longitudinally along and into the protector member from the mounting surface. At least two resilient mounting clips join the protector member to the wall. Each mounting clip has a mounting base adapted to be affixed to the wall in concealed relation to the protector member and at least one resilient hook projecting from the base and received in the groove in captured relation.

In the wall protector assembly of the present invention, the mounting clips are attached to the wall and in turn accept the protector member and retain it on the wall by reception of the hooks in the groove in the concealed mounting surface of the mounting clips. Accordingly, there are no visible screw heads or plugs. The mounting clips are likewise fully hidden from view. A wall protection assembly embodying the invention is economical, attractive, and easy to install. The hooks of the mounting clips firmly retain the protector member in place on the wall.

In preferred embodiments, the mounting surface of the protector member has a longitudinally extending recess that receives the bases of the mounting clips, thus permitting the side margins of the mounting surface of the protector member to engage the wall. The mounting surface of the protector member also has recesses for accepting the heads of the fasteners that attach the mounting clips to the wall. Each resilient hook includes a leg extending from the base and receivable in the slot and a tang bent at an acute angle to the leg.

When the wall protector is a crash rail, there are two elongated grooves extending parallel to each other in spaced-apart relation, and each clip has two hooks, one of which is receivable in one of the grooves and the other of which is receivable in the other groove. Each mounting clip has a planar base and a hook at each end of the base. The leg of each hook forms a right angle with the base, and side edges of the base, each leg, and each tang lie in parallel spaced-apart planes. A hook of that configuration is easy and economical to make, inasmuch as it can be formed by bending from a strip of uniform width.

A wall protector in the form of a corner guard has two side portions joined to each other at a right angle. In a preferred embodiment of a corner guard assembly, according to the present invention, a single elongated groove for receiving the hooks is provided at the corner juncture of the side portions and forms substantially equal angles with each side portion. Each mounting clip has a single hook. The base of each mounting clip has two arm portions joined at a right angle, and the hook is located at the juncture of the arm portions with the leg of the hook forming substantially equal angles with the arm portions of the base. For economical manufacture, the hook is formed of a segment cut along three sides from one arm of the base and bent out from that arm and then bent again to form the tang. Adjacent mounting clips are, preferably installed with the hooks facing in opposite directions.

For a better understanding of the invention, reference may be made to the following description of exemplary embodiments, taken in conjunction with the accompanying drawings.

DESCRIPTION OF THE EMBODIMENTS

Figure 1:
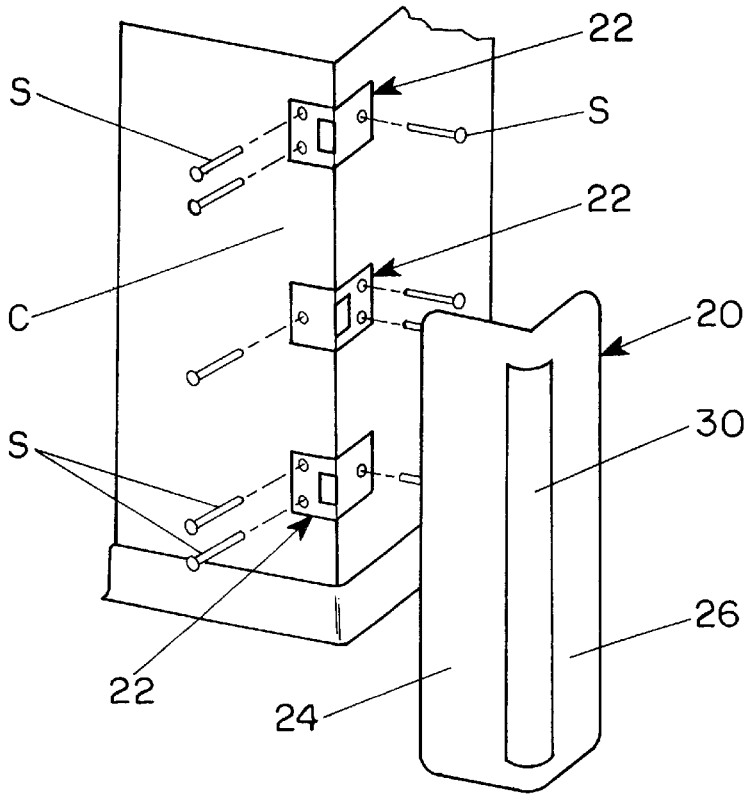
FIG. 1 is a schematic three-quarter pictorial view of a corner guard assembly embodying the present invention.
Figure 2:
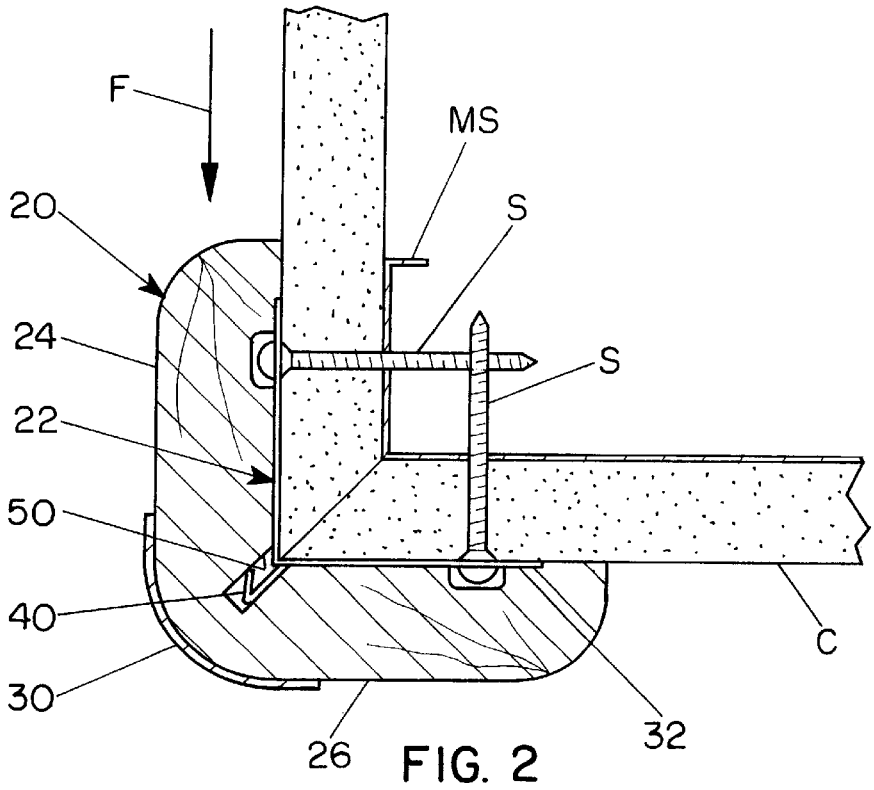
FIG. 2 is a partial detail top cross-sectional view of the corner guard assembly of FIG. 1, as installed on a wall corner.

Referring first to FIGS. 1 and 2, a corner guard assembly consists of a corner guard member 20 and at least two mounting clips 22. The corner guard member shown in the drawings has a body of natural wood having two side portions 24 and 26 that are joined at a right angle. The external surface of the corner guard member has a rounded corner at the juncture of the side portions. A metal impact member 30, which is secured to the external corner by an adhesive, protects the wood body from marring by impacts and is also a decorative feature.

Figure 3:
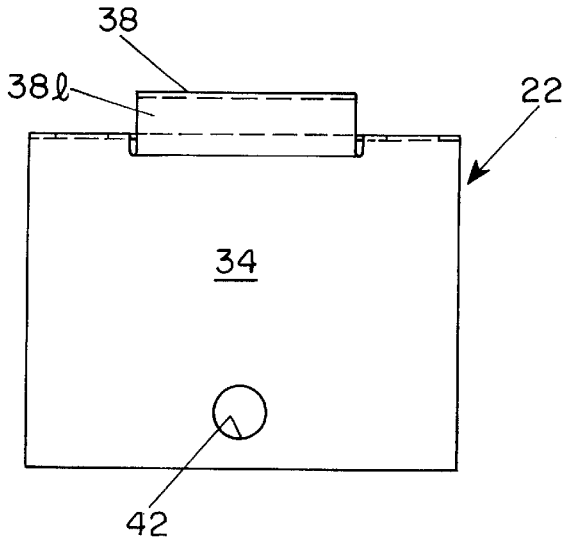
FIG. 3 is a plan view of one arm portion of the mounting clip of the corner guard assembly of FIGS. 1 and 2.
Figure 4:
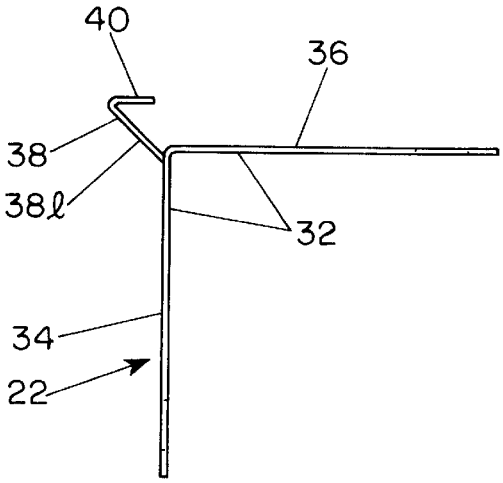
FIG. 4 is a view of one edge of the mounting clip of the corner guard assembly of FIGS. 1 to 3 and is a mirror image of the other edge.
Figure 5:
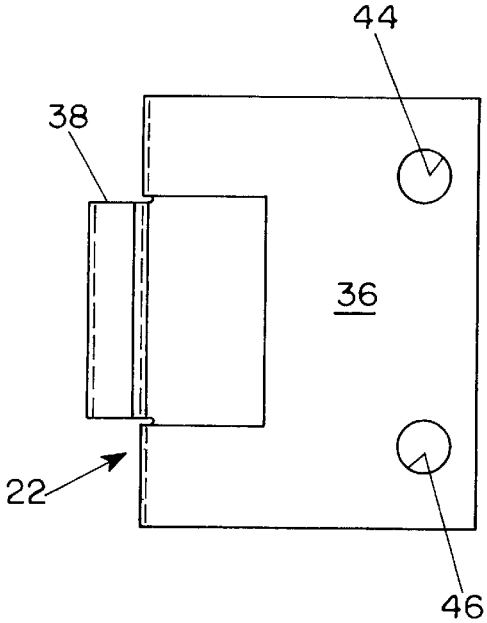
FIG. 5 is a plan view of the other arm portion of the mounting clip of the corner guard assembly of FIGS. 1 to 4.

The clips 22 are identical. Each clip 22 (see FIGS. 3 to 5) is formed from a strip of spring stainless steel and has a mounting base portion 32 composed of arm portions 34 and 36 that meet at a right angle. One arm portion 36 is cut along three cut lines to form a rectangular segment adjacent the juncture of the arm portions 34 and 36 that is bent out from the arm portions to form a resilient hook 38. The hook 38 has a leg 381 that extends from the corner of the mounting base portion 32 and forms substantially equal angles (135 degrees) with the arm portions 34 and 36. A portion at the end of the rectangular segment that forms the hook 38 is bent back toward the arm portion 36 of the mounting base to form a tang 40. The tang lies at an internal angle to the leg 381 of about 45 degrees.

The mounting clips 22 are installed in vertically spaced-apart relation (see FIG. 1) on an external wall corner C of a building room or corridor by self-drilling screws S that pass through holes 42, 44, and 46 in the arm portions 34 and 36 of the mounting base portion 32 and the drywall panels and into the metal stud MS at the corner C. One arm portion 34 has a single hole 42 and the other arm portion has a pair of holes 44 and 46, the hole 42 being vertically staggered relative to the holes 44 and 46 so that the tip portions of the screws do not meet behind the stud. Adjacent mounting clips 22 are mounted with the tangs 40 facing in opposite directions (see FIG. 1) so that the gripping action of the tang of one clip of a pair of adjacent clips acts generally parallel to one wall of the corner C while the gripping action of the tang of the other clip of a pair of adjacent clips acts generally parallel to the other wall of the corner C.

Figure 7:
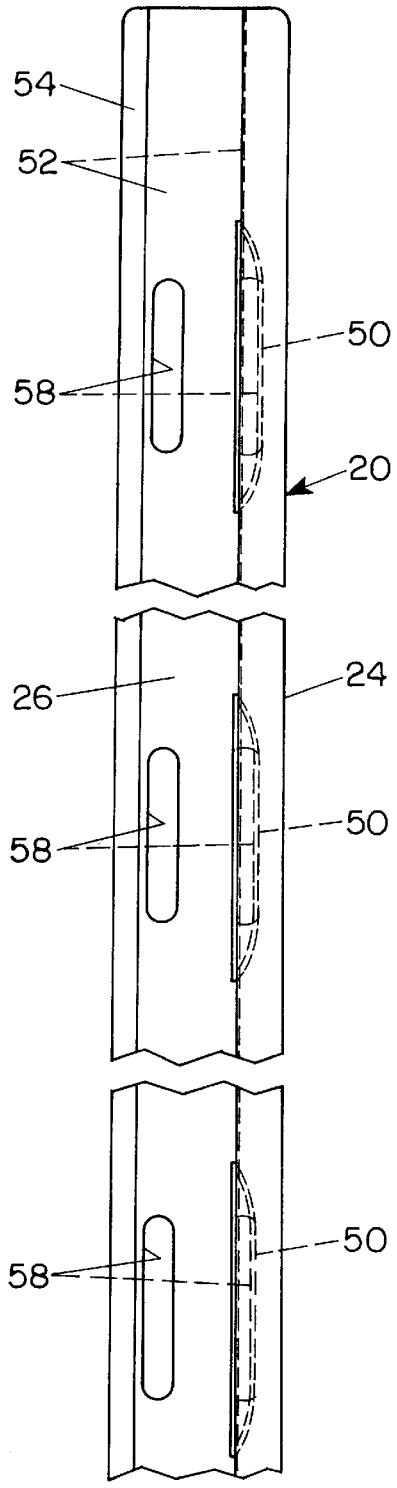
FIG. 7 is a left side elevational view of the protector member of the corner guard assembly of FIGS. 1 to 6 and is the mirror image of the right side.
Figure 8:
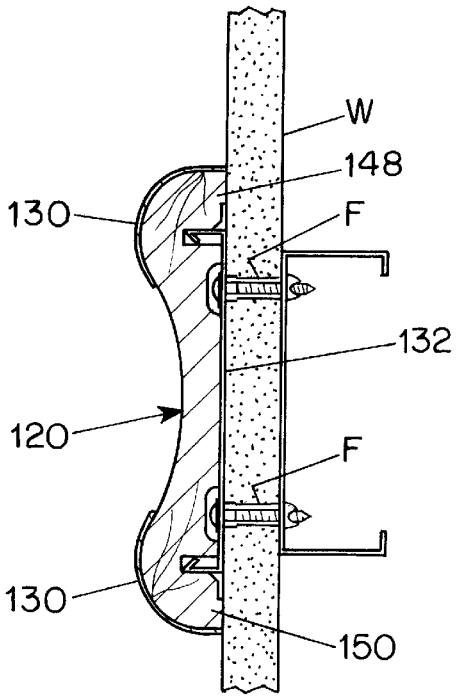
FIG. 8 is and end cross-sectional view of a crash rail assembly embodying the present invention, showing it as installed on a wall.
Figure 9:
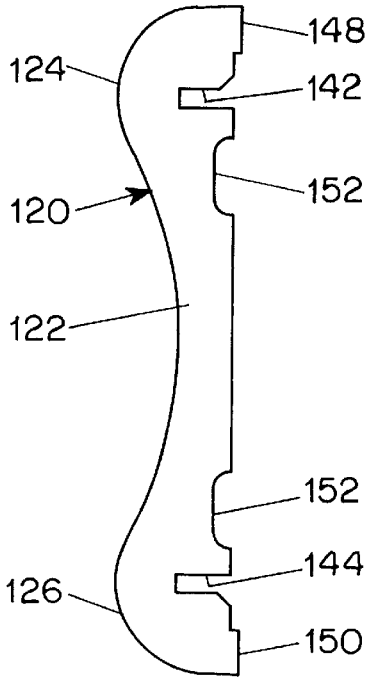
FIG. 9 is an end view of the body of the protector member of the crash rail assembly of FIG. 8.
Figure 10:
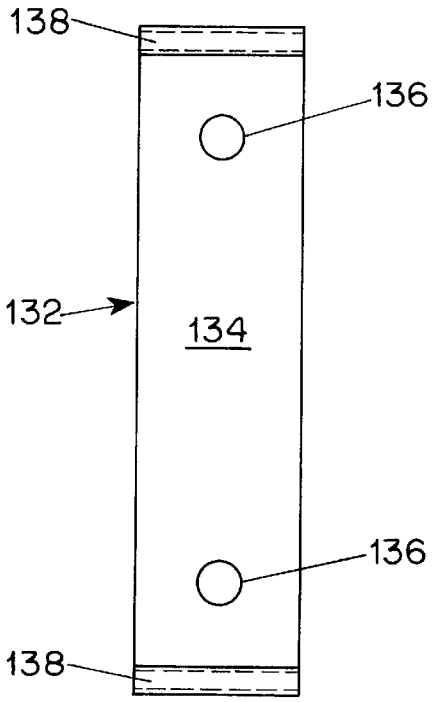
FIG. 10 is a plan view of the mounting clip of the crash rail assembly of FIG. 8.
Figure 11:
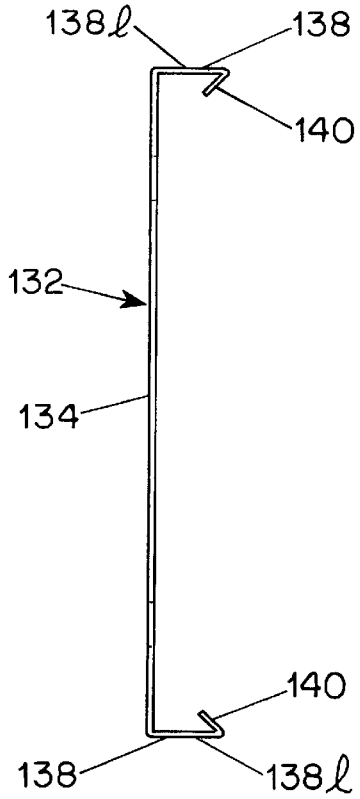
FIG. 11 is an end view of the mounting clip of the crash rail assembly of FIG. 8.

The corner guard member has grooves 50 (see FIG. 7) along the mounting surface (the surface that faces the wall) at the juncture of the side portions 24 and 26 at positions corresponding to the locations of the clips. The lengths of the grooves are greater than the widths of the hooks 38 of the clips 22 so that the clips need only be placed at approximately the proper locations vertically on the wall corner. Each groove 50 forms substantially equal angles with the side portions of the corner guard member and is slightly narrower than the overall width of the hook 38 of the clip 22. Accordingly, when the corner guard member is pushed onto the clips 22, the tang 40 of each clip is slightly bent toward the leg 381 and is thereby placed under a preload so that the tip of the tang is forcibly engaged with a side wall of the slot.

Components of forces due to impacts on the corner guard assembly that are parallel to one or the other walls of the corner and tend to dislodge the corner guard member are transmitted to the tips of the tangs that face that component of force. For example, a force component F indicated by the arrow F in FIG. 2 acts on the tip of the tang 40. Components of forces exerted on the corner guard assembly in a direction perpendicular to one or the other walls of the corner C are, of course, resisted by engagement of one of the side portions 24, 26 with the wall surface.

Figure 6:
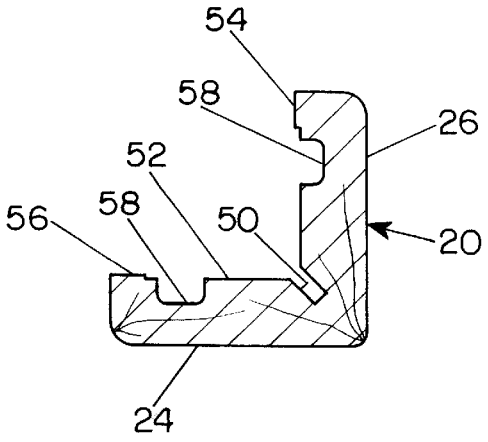
FIG. 6 is an end cross-sectional view of the protector member of the corner guard assembly of FIGS. 1 to 6.

The corner guard member has a shallow recess 52 (FIG. 6) in the mounting surface that extends continuously longitudinally along each side portion 24 and 26 and laterally from the juncture of the side portions toward the side edges but leaves bands 54 and 56 adjacent each edge of the corner guard member that engage the surfaces of the walls. The recess 52 accepts the arm portions 34 and 36 of the mounting clips 22 but allows the bands 54 and 56 to engage the walls. Recesses 58 are formed in the mounting surface of each side portion of the corner guard member to receive the heads of the screws S.

An embodiment of a wall protection assembly in the form of a crash rail is shown in FIGS. 8 to 11. A crash rail member 120 of uniform cross section along its length, is made of solid wood, and has in cross section a concavely rounded medial external surface 122 and convexly rounded top and bottom edge surfaces 124 and 126. Metal protector plates 130 (FIG. 8) cover the edge surfaces and prevent them from becoming marred by impacts. Clips 132 secured to the wall W by fasteners F at a suitable spacing retain the crash rail member on the wall.

Each clip 132 is formed from a strip of spring stainless steel of uniform width and includes a mounting base portion 134 having holes 136 for the fasteners F and a hook 138 at each end of the mounting base portion. Each hook has a leg portion 1381 that is bent out from the mounting base portion perpendicularly and a tang 140 that is bent back toward the mounting base portion 134 at an included angle of about 45 degrees to the leg 138*l*.

In a manner similar to the corner guard member, the crash rail member 120 has: (1) grooves 142 and 144 located along the mounting surface that accept the hooks 138 of the mounting clips 132; (2) a recess 146 that extends longitudinally continuously and partway laterally along the mounting surface, but leaving bands 148 and 150 adjacent the edges that engage the wall W, that accept the mounting base portions 134 of the clips 132; and (3) grooves 152 that accept the heads of the fasteners. The grooves 142 and 144 are slightly narrower than the overall widths of the hooks so that when the crash rail member 120 is pushed into place on the clips, the tangs 140 are elastically preloaded. Any force that might tend to pull the crash rail member away from the wall is resisted by the tips of the tangs 140, which tend to dig into the walls of the grooves that they engage. Because of its shape and its orientation horizontally along the wall, the crash rail assembly is subject to forces due to impacts that act primarily toward the wall and horizontally parallel to the wall. Forces due to impacts that tend to dislodge the crash rail member from the clips are unlikely.

What is claimed is:

1. A wall protection assembly, comprising an elongated wall protector member having an impact surface adapted to face away from a wall and a mounting surface adapted to face the wall;

at least two elongated grooves extending longitudinally along and into the protector member from the mounting surface; and at least two resilient mounting clips, each mounting clip having a mounting base adapted to be affixed to the wall in concealed relation to the protector member and at least one resilient hook projecting from the base and adapted to be received in one of the grooves of the wall protector member in captured relation;

wherein the hook is feinted of a segment cut along three sides from one arm of the base and bent out from said one arm.

2. The wall protection assembly according to claim 1, wherein the mounting surface of the protector member has a longitudinally extending recess adapted to receive the bases of the mounting clips.

3. The wall protection assembly according to claim 1, wherein the mounting surface of the protector member has recesses for accepting heads of fasteners for attaching the mounting clips to the wall.

4. The wall protection assembly according to claim 1, wherein each resilient hook includes a leg extending from the base and receivable in the groove and a tang bent at an acute angle to the leg, and having a tip engaging a side wall of the groove.

5. The wall protection assembly according to claim 1, wherein the mounting surface of the protector member has a longitudinally extending recess adapted to receive the bases of the mounting clips, the mounting surface of the protector member has recesses for accepting heads of fasteners for attaching the mounting clips to the wall, and each resilient hook includes a leg extending from the base and receivable in the groove and a tang bent at an acute angle to the leg and having a tip engaging a side wall of the groove.

6. The wall protection assembly according to claim 1, wherein the wall protector is a crash rail, there are two longitudinal grooves extending parallel to each other in spaced-apart relation, and each clip has two hooks, one of which is receivable in one of the grooves and the other of which is receivable in the other groove.

7. The wall protection assembly according to claim 6, wherein the mounting surface of the protector member has a longitudinally extending recess adapted to receive the bases of the mounting clips.

8. The wall protection assembly according to claim 6, wherein the mounting surface of the protector member has recesses for accepting heads of fasteners for attaching the mounting clips to the wall.

9. The wall protection assembly according to claim 6, wherein each resilient hook includes a leg extending from the base and receivable in the slot and a tang bent at an acute angle to the leg and having a tip engaging a side wall of the groove.

10. The wall protection assembly according to claim 6, wherein the mounting surface of the protector member has a longitudinally extending recess adapted to receive the bases of the mounting clips, the mounting surface of the protector member has recesses for accepting heads of fasteners for attaching the mounting clips to the wall, and each resilient hook includes a leg extending from the base and receivable in the slot and a tang bent at an acute angle to the leg and having a tip engaging a side wall of the groove.

11. The wall protection assembly according to claim 10, wherein each mounting clip has a planar base and a hook at each end of the base.

12. The wall protection assembly according to claim 11, wherein the leg of each hook forms a right angle with the base, and side edges of the base, each leg, and each tang lie in parallel spaced-apart planes.

13. The wall protection assembly according to claim 1, wherein the wall protector is a corner guard and has two side portions joined at a right angle, there is for each clip a single elongated groove located at the juncture of the side portions and forming substantially equal angles with each side portion, and each mounting clip has a single hook.

14. The wall protection assembly according to claim 13, wherein the mounting surface of the protector member has a longitudinally extending recess adapted to receive the bases of the mounting clips.

15. The wall protection assembly according to claim 13, wherein the mounting surface of the protector member has recesses for accepting heads of fasteners for attaching the mounting clips to the wall.

16. The wall protection assembly according to claim 13, wherein the resilient hook of each mounting clip includes a leg extending from the base and receivable in the slot and a tang bent at an acute angle to the leg and having a tip engaging a side wall of the groove.

17. The wall protection assembly according to claim 13, wherein the mounting surface of the protector member has a longitudinally extending recess adapted to receive the bases of the mounting clips, the mounting surface of the protector member has recesses for accepting heads of fasteners for attaching the mounting clips to the wall, and each resilient hook includes a leg extending from the base and receivable in the slot and a tang bent at an acute angle to the leg and having a tip engaging a side wall of the groove.

18. The wall protection assembly according to claim 13, wherein the base of each mounting clip has two arm portions joined at a right angle, and the hook is located at the juncture of the arm portions.

19. The wall protection assembly according to claim 18, wherein the leg of the hook forms substantially equal angles with the base.

20. A wall protection assembly, comprising an elongated wall protector member having an impact surface adapted to face away from a wall and a mounting surface adapted to face the wall;

at least two elongated grooves extending longitudinally along and into the protector member from the mounting surface; and at least two resilient mounting clips, each mounting clip having a mounting base adapted to be affixed to the wall in concealed relation to the protector member and at least one resilient hook projecting from the base and adapted to be received in one of the grooves of the wall protector member in captured relation;

wherein the mounting surface of the protector member has a longitudinally extending recess adapted to receive the bases of the mounting clips.

21. A wall protection assembly, comprising an elongated wall protector member having an impact surface adapted to face away from a wall and a mounting surface adapted to face the wall;

at least two elongated grooves extending longitudinally along and into the protector member from the mounting surface; and at least two resilient mounting clips, each mounting clip having a mounting base adapted to be affixed to the wall in concealed relation to the protector member and at least one resilient hook projecting from the base and adapted to be received in one of the grooves of the wall protector member in captured relation;

wherein the mounting surface of the protector member has recesses for accepting heads of fasteners for attaching the mounting clips to the wall.

* * * * *

UNITED STATES PATENT AND TRADEMARK OFFICE

CERTIFICATE OF CORRECTION

PATENT NO. : 6,601,355 B2
DATED : August 5, 2003
INVENTOR(S) : Robert Kreitz et al.

It is certified that error appears in the above-identified patent and that said Letters Patent is hereby corrected as shown below:

Column 5,
Line 5, "feinted" should read -- formed --

Signed and Sealed this

Second Day of December, 2003

JAMES E. ROGAN
*Director of the United States Patent and Trademark Office*